US006320327B1

(12) United States Patent
Lavatelli et al.

(10) Patent No.: US 6,320,327 B1
(45) Date of Patent: Nov. 20, 2001

(54) REMOTELY CONTROLLED REVOLVING ILLUMINATED MUSICAL CHRISTMAS TREE STAND

(75) Inventors: Alesandro Lavatelli; Giuliano Lengo, both of Turin (IT)

(73) Assignee: Puleo Tree Co., South Palinfield, NJ (US)

( * ) Notice: Subject to any disclaimer, the term of this patent is extended or adjusted under 35 U.S.C. 154(b) by 0 days.

(21) Appl. No.: 09/629,151

(22) Filed: Jul. 31, 2000

(51) Int. Cl.[7] ..... H05B 37/00
(52) U.S. Cl. ..... 315/185 S; 362/269
(58) Field of Search ..... 315/185 S, 185 R; 362/84, 97, 249, 269, 431, 806

(56) References Cited

U.S. PATENT DOCUMENTS

| | | | | |
|---|---|---|---|---|
| 4,153,860 | | 5/1979 | Vonick | 315/155 |
| 4,928,568 | * | 5/1990 | Snavely | 362/97 |
| 5,455,750 | | 10/1995 | Davis et al. | 362/123 |
| 5,485,068 | | 1/1996 | Vaught | 315/568.1 |
| 5,575,242 | * | 11/1996 | Davis et al. | 340/573 |
| 5,634,622 | | 6/1997 | Pye | 248/371 |
| 5,647,569 | | 7/1997 | Sofy | 248/522 |
| 6,037,679 | * | 3/2000 | Pirillo | 362/806 |

* cited by examiner

*Primary Examiner*—Don Wong
*Assistant Examiner*—Thuy Vinh Tran
(74) *Attorney, Agent, or Firm*—Jacobson Holman, PLLC

(57) ABSTRACT

A reversible revolving, illuminated, musical and speaking Christmas tree stand that is remotely controlled. The stand rotatably supports an artificial or natural Christmas tree, other decorative trees or other devices supported for rotational movement about a generally vertical axis. The stand includes a structure for reversibly rotatably, supportingly engaging a tree or other device, a structure for illuminating the tree or other device and a structure for producing musical renditions, songs or the like relating to the tree or other device and an infrared remote control by which all functions of the stand can be independently controlled without approaching the tree. The stand has a housing shaped and configured to carry out the theme or symbolism of the tree or other device.

16 Claims, 5 Drawing Sheets

REMOTELY CONTROLLED REVOLVING ILLUMINATED MUSICAL CHRISTMAS TREE STAND

BACKGROUND OF THE INVENTION

1. Field of the Invention

The present invention generally relates to a reversible revolving illuminated musical and speaking Christmas tree stand and more specifically to a remotely controlled stand of this type. The stand is adapted to rotatably support an artificial or natural Christmas tree, other decorative trees or other devices for reversible rotational movement about a generally vertical axis. The stand includes a structure for supportingly engaging the tree or other device, structure for illuminating the tree or other device and an audio device for producing a musical rendition, song or the like relating to the tree or other device and a remote control by which all functions of the stand can be independently controlled at a distance from the stand. The stand has a housing shaped and configured to carry out the theme or symbolism of the tree or other device. The remote control includes an infrared transmitter which is preferably hand held and the stand includes an infrared signal receiver to control the functions in accordance with the infrared control device.

2. Description of the Prior Art

Various types of rotating and non-rotating Christmas tree stands are well known in the art as well as stands or Christmas trees which incorporate lights, music and manual control apparatus. Also, various remote control devices are provided to enable remote control of various electrically powered appliances or devices. The following U.S. patents generally relate to this field of endeavor. U.S. Pat. Nos. 4,153,860 5,485,068 5,647,569 5,455,750 5,634,622.
While the prior art discloses various remotely controlled devices and manually controlled stands supporting a Christmas tree for rotation, the specific arrangement of the components and the remote control characteristics of the present invention are not found in the prior art.

SUMMARY OF THE INVENTION

The remotely controlled, illuminated, musical and speaking Christmas tree stand of the present invention comprises a hollow housing of generally star shaped configuration. The tree stand includes an upwardly and inwardly tapering peripheral wall having a substantially flat closed and removable bottom which can rest upon a supporting surface. The stand further includes structure at its upper end for clampingly engaging a Christmas tree, a drive mechanism for reversibly rotating the Christmas tree, a mechanism providing electrical energy to decorative light bulbs on the tree and an audio device for producing music, song and/or vocal message traditionally associated with the Christmas season.

In accordance with the present invention, the stand is provided with an infrared control signal receiver either on the housing or extended from the housing which receives infrared signals transmitted from a portable battery powered control device. The portable control device is provided with manually controlled switches to selectively and independently energize the lights on the tree, selectively and reversibly rotate the tree and selectively operate the audio device. This enables operation and control of the functional capabilities of the stand from a remote location by utilizing the portable infrared control device in a manner well known in the art of remote controlling various appliances such as television and the like.

Accordingly, it is an object of the present invention to provide a stand for a Christmas tree or similar device utilizing components that enable the tree or other device to be reversibly rotated about a vertical axis, that enable decorative lights on the tree or other device to be energized when rotating or when stationary and that actuate an audio device for producing music or songs relating to the Christmas season, or that relate to other decorative devices supported by the stand. All functional operations of the stand are controlled by a remote infrared control device that transmits signals to an infrared signal receiver either on the stand or located adjacent to and connected to the stand to facilitate operation of all functions of the stand from a remote location.

Another object of the invention is to provide a remote control for a Christmas tree or other device as set forth in the preceding object in which the remote control device provides an infrared signal to the receiver associated with the stand for independently controlling each of the functions, operating selected multiple functions and simultaneous operation of all functions from a remote location.

A further object of the invention is to provide a remotely controlled, illuminated, musical revolving Christmas tree stand which stably supports a natural or artificial Christmas tree and is simple, safe and dependable in operation, and relatively inexpensive to manufacture, maintain and operate.

Still another object of the invention is to provide a Christmas tree stand having a star shaped configuration in green or other color or colors to conform with the symbolism of the tree and the Christmas season.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
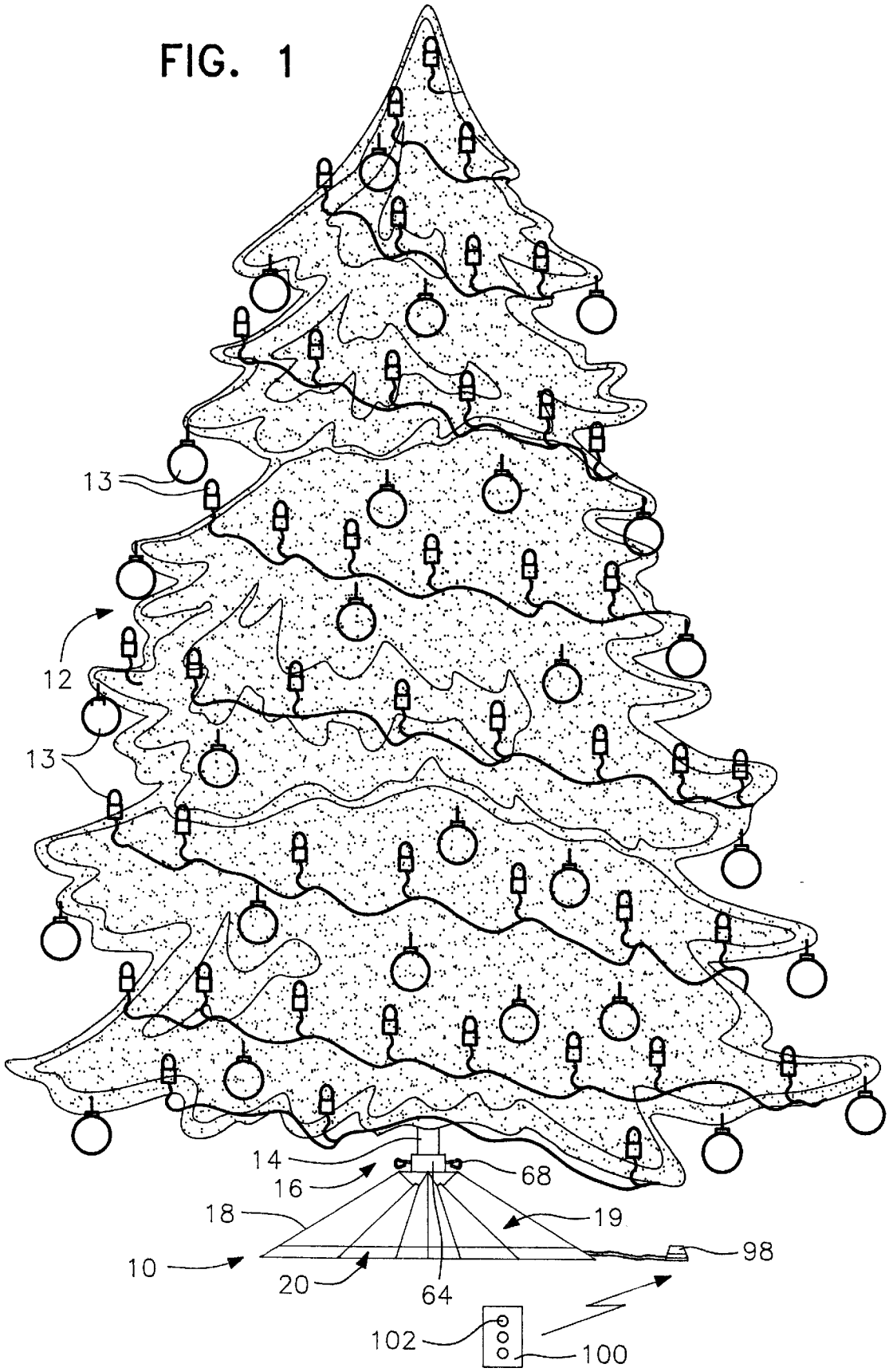
FIG. 1 is a side elevational view of a Christmas tree with the Christmas tree stand of the present invention supporting the tree.
Figure 2:
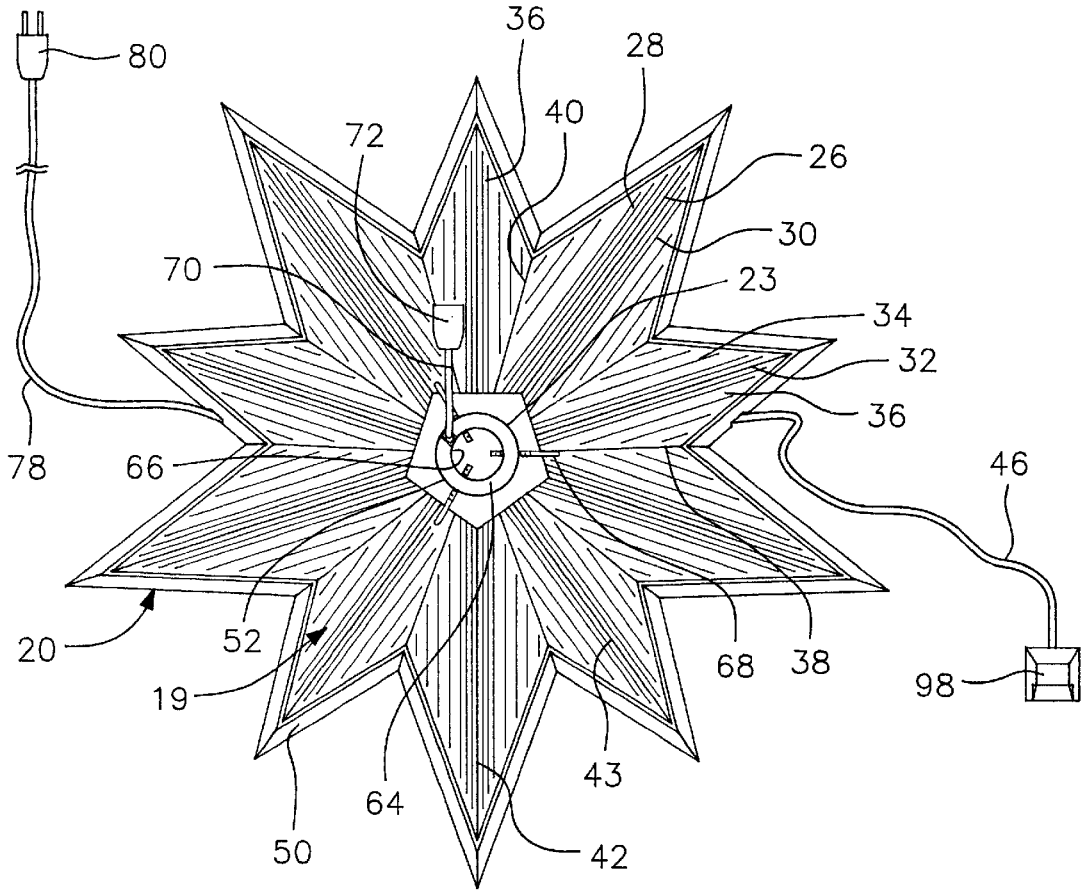
FIG. 2 is a top plan view of the stand of the present invention.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose. As used herein, the term "Christmas sounds" or "sounds" is intended to include music, songs, verbal message, or any combination, of the Christmas season or other circumstances consistent with the supported decoration.

Referring to the drawings, the Christmas tree stand of the present invention is generally designated by reference numeral 10 and, as illustrated in FIG. 1, an artificial Christmas tree generally designated by reference numeral 12 is supported vertically by the stand 10. The Christmas tree 12 will have vertical and circumferential dimensions enabling the stand 10 to stably support the tree 12. The Christmas tree is also provided with strings of lights, decorative ornaments and other decorative materials, schematically illustrated at 13, which are normally employed to decorate a Christmas tree. The tree 12 includes a trunk 14 received in the stand 10 and clampingly supported therein by clamp bolts or other clamp structure, generally designated by reference numeral 16. The stand 10 includes a hollow housing, generally designated by reference numeral 18, which has a generally star shaped configuration and includes a top wall 19 tapering downwardly and outwardly from its upper end to a lower end. A bottom wall generally designated by reference numeral 20 is attached to and forms a closure for the top wall 19.

Figure 3:
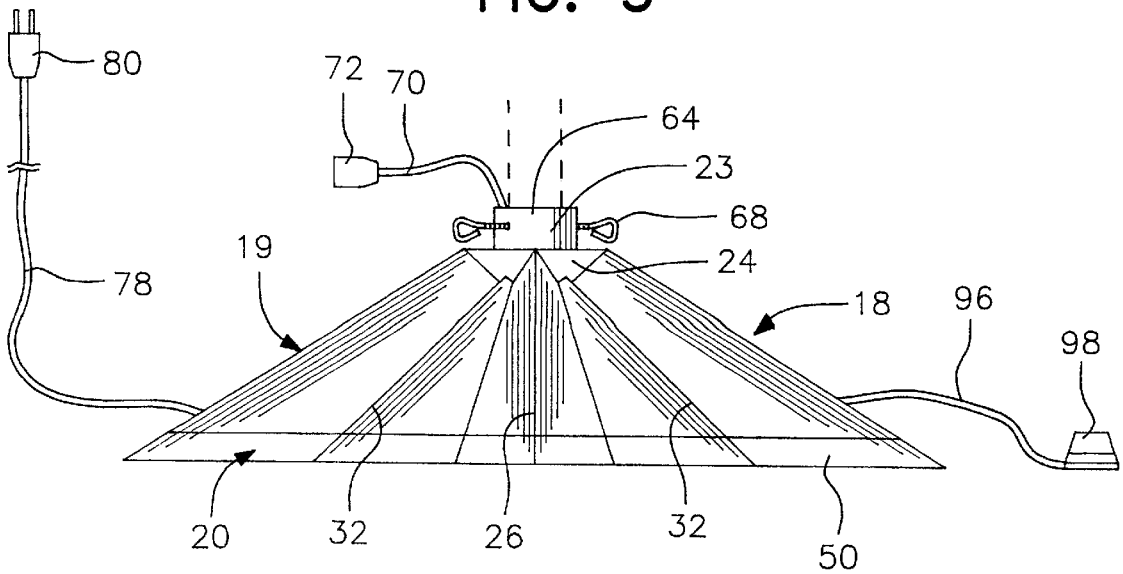
FIG. 3 is an enlarged side elevational view of the stand of the present invention.
Figure 4:
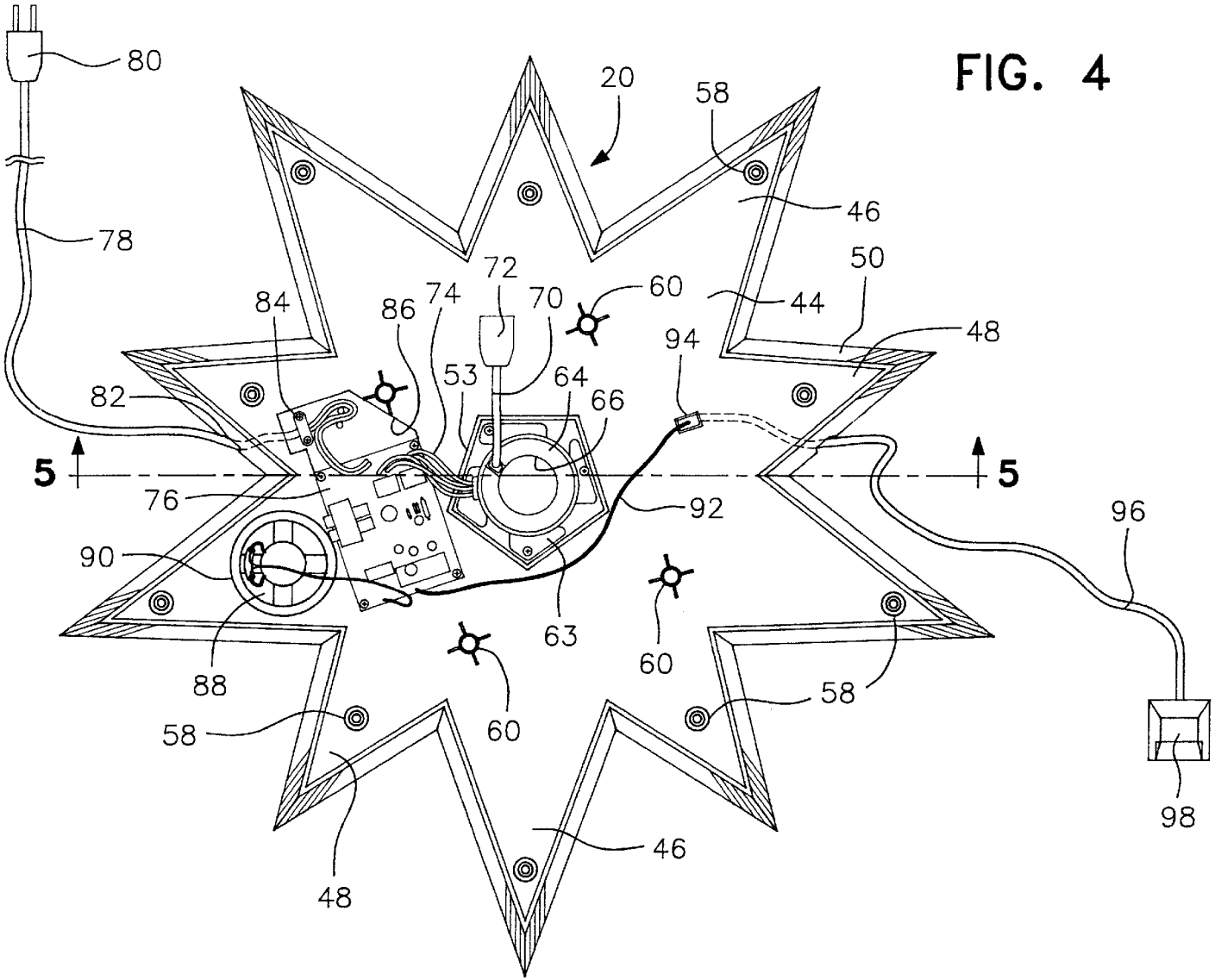
FIG. 4 is a top plan view of the stand of the present invention with the top wall removed in order to illustrate the relationship of the components on the bottom wall.
Figure 5:
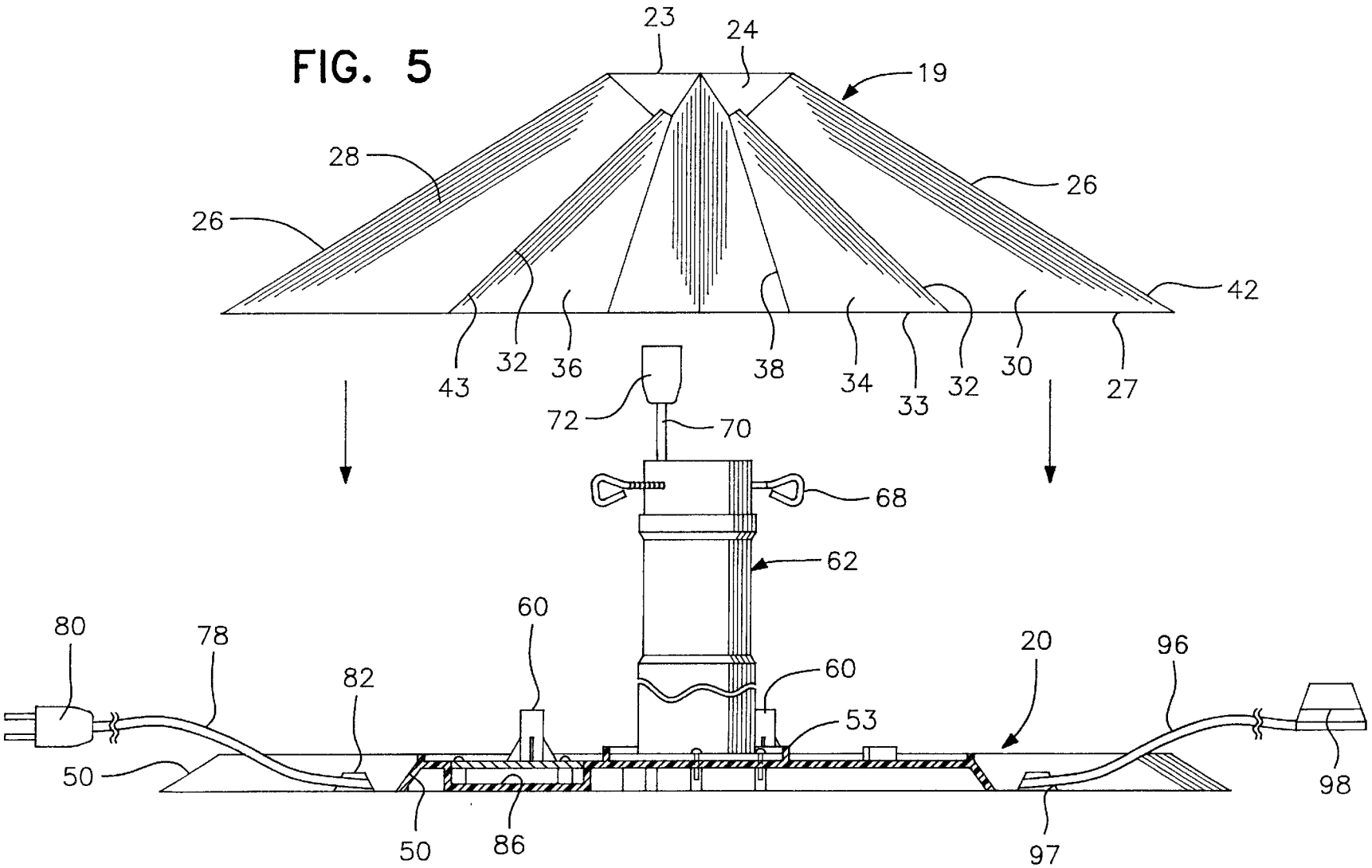
FIG. 5 is a vertical sectional view of the stand of the present invention, on an enlarged scale, taken along section line 5—5 on FIG. 4, with the top wall of the stand removed and spaced above the bottom wall.

FIGS. 2–6 illustrate in more detail the specific structure of the housing 18 including the top wall 19 and the bottom wall 20, each of which are generally star shaped in configuration. The top wall 19 preferably includes a generally horizontal, planar pentagonal central top member 23 with the sides extending down from the top member 23 forming vertically depending walls 24. Extending downwardly from each corner of the pentagonal top member 23 is a plurality of downwardly inclined ridges 26 each defined by a pair of inclined walls 28 and 30. Each vertically depending wall 24 is connected to a ridge 32 which extends downwardly and outwardly in an inclined manner with each ridge 32 joining with a vertical wall 24 at a level below the pentagonal top 23, as illustrated in FIG. 3. The ridge 32 is defined by walls 34 and 36. Adjacent inclined walls 34 and 30 are connected to form a valley 38 and adjacent walls 28 and 36 are connected to form a valley 40. Thus, alternating ridges 26 and 32 and alternating valleys 38 and 40 define alternating star points 42 and 43 which are located at different radial distances from the vertical center of the housing as illustrated in FIGS. 2–6. The lower edges 27 and 33 of the ridges 26 and 32 are straight and in alignment to form a straight bottom edge on the top wall 19.

The bottom wall 20 includes a planar, horizontal panel or wall 44 provided with a periphery defined by longer and shorter star points 46 and 48 in alternating relation around the periphery of the bottom wall 20. The tip ends of the star points 46 and 48 are oriented in different radial spaced relation to the center of the stand 10. The entire periphery of the wall 44 is provided with an upwardly and inwardly inclined narrow flange 50 which extends above and below wall 44. The upper edge of flange 50 telescopically receives the lower edges of the walls 28, 30, 34, 36 of the top wall 19 with the flange 50 telescoping over the outer surface of the lower edge of the walls which define the star points 42 and 43 on the top wall 19.

The planar pentagonal top member 23 includes a central circular opening 52 (see FIG. 6) and vertical walls 24 extend downwardly to a point spaced a short distance above the lower edges 27 and 33 of the top wall 19 to provide rigidity to the top wall 19. The bottom wall 44 includes a central short upstanding pentagonal flange 53 aligned with and forming a continuation of walls 24. When assembled, the lower edges of walls 24 engage the upper edge of flange 53 to rigidify the central portion of top wall 19 together with the bottom wall 20. The top wall 19 also includes reinforcing walls 54 extending outwardly from each apex of the pentagonal vertical walls 24 along the underside of the ridges 26. The bottom edges of the reinforcing walls 54 are spaced so as not to protrude below the plane defined by the lower edge of the top wall 19 and are spaced above the bottom of the vertical pentagonal walls 24. The top wall 19 is of unitary, monolithic construction, preferably of rigid plastic material which may be colored, preferably green or in any other color or colors desired depending upon the decorative device supported by the stand.

Figure 6:
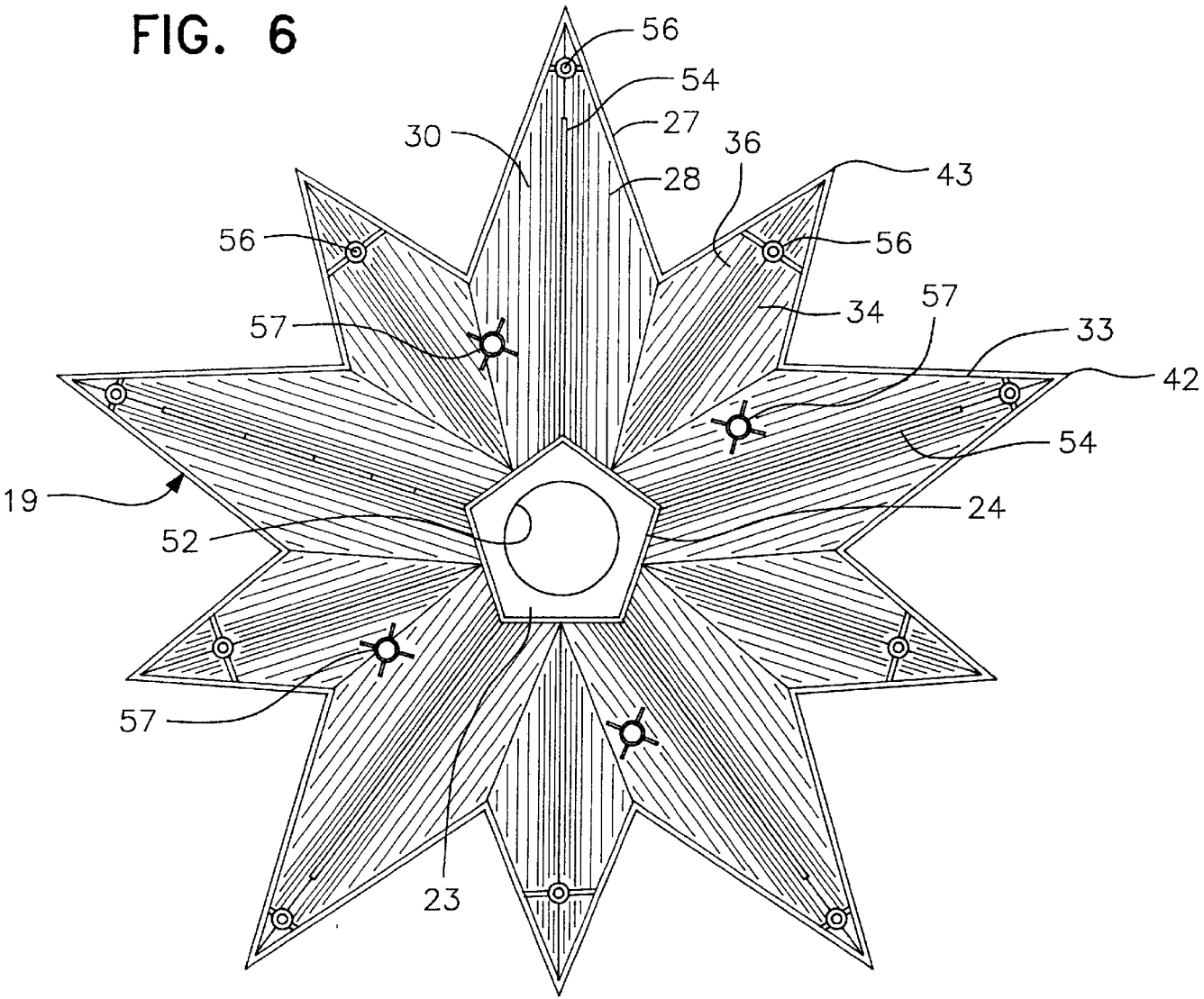
FIG. 6 is a bottom plan view of the top wall of the stand of the present invention.

As shown in FIG. 6, the bottom of the top wall 19 includes screw receiving studs 56 spaced inwardly from the underside of each star point at the outer end of each ridge 26 and 32. The screw receiving studs 56 on ridges 32 are preferably spaced farther from the star point than the studs 56 on ridges 26. Also, screw receiving studs 57 are spaced inwardly and upwardly from the lower end of certain of the valleys 40 between inclined walls 30 and 34 or 28 and 36. These studs 56 and 57 are integral with the top wall 19 and receive fastening screws which extend through apertures 58 in the star points 48 of the bottom wall 44 which are aligned with studs 56 and through upstanding studs 60 on the bottom wall 44 which are aligned with the studs 57.

Mounted centrally in the bottom wall 20 and disposed within the upstanding pentagonal flange 53 is a vertically extending generally cylindrical housing, generally designated by reference numeral 62, having a plurality of partial peripheral flanges 63 along the base edge thereof which are secured to the bottom wall panel 44, such as by screw fasteners. The cylindrical housing 62 includes a reversible motor and a rotary electrical contact assembly interiorly thereof, the details of which are not shown and which are of conventional construction. An output clamp ring 64 extends above the housing 62 and is driven by the motor. The clamp ring 64 includes a cylindrical interior 66 in which a Christmas tree trunk can be inserted. A plurality of radial clamp screws 68 are threaded into the clamp ring 64 and the inner ends of screws 68 clampingly engage the Christmas tree trunk inserted into interior 66 in a well known manner. The clamp screws 68 may have a loop shaped outer end to facilitate rotation of the clamp screws. Also, an electrical conductor 70 extends through the clamp ring 64 and terminates in a receptacle 72 at its exposed free end in a manner such that the receptacle 72 is oriented adjacent the upper end of the housing 62 but is movable in relation thereto within the limits of the flexible electrical conductor 70. This electric receptacle 72 enables a male electrical plug to be inserted therein to supply electrical energy to the lights on a Christmas tree supported by the stand.

The lower end of the cylindrical housing 62 includes a plurality of electrical conductors 74 extending from a circuit board 76 that is mounted on the bottom wall panel 44. The circuit board 76 is provided with electrical components which receive electrical energy from an electric cord 78 having a male plug 80 on the free end thereof. The electric cord 78 extends through a notch 82 in the flange 50 and through a strain relief structure 84 in a recess 86 in the bottom wall panel 44. The circuit board 76 also includes components of an audio producing device including a speaker 88 mounted in an opening 90 in the bottom wall panel 44. The speaker 88 includes a perforated cover positioned below the bottom wall panel 44 to facilitate sound emissions from the audio producing device. The electrical components include switches for the reversible electric motor, connecting electrical energy to the female receptacle 72 and operating the audio producing device. These switches are operated by electrical conductors 92 extending to an input jack 94 in the bottom wall panel 44 which opens to the bottom. A male jack component is inserted from the undersurface of the panel 44 from an electrical conductor 96 which extends out through a notch 98 in the flange 60 and has the infrared receiver 98 at the outer end thereof. The infrared receiver 98 can then be positioned so that it is accessible to an infrared transmitter 100 which has multiple switches 102 including a switch for selectively actuating the audio producing device, a switch for selectively energizing the electric lights on the Christmas tree and a switch for selectively rotating the clamp ring 64 and Christmas tree supported thereby in either rotational direction.

The foregoing is considered as illustrative only of the principles of the invention. Since numerous modifications and changes will readily occur to those skilled in the art, it is not desired to limit the invention to the exact construction and operation shown and described. For example, while infrared signals are the preferred means for remote transmission, other wireless frequencies or signals for remotely controlling the operation of the stand could be used. Further, other possible decorative devices supported by the stand 10 could be controlled remotely by the transmitter 100, such as blinking lights, lighted color wheels and the like. Accordingly, all suitable modifications and equivalents may be resorted to, falling within the scope of the invention.

What is claimed as new is as follows:

1. A Christmas tree stand comprising a hollow housing rotatably supporting a Christmas tree, said housing including a bottom wall for engaging a support surface and a top wall, a power device in said housing to selectively rotate the Christmas tree, means selectively supplying electrical energy to illumination elements on the Christmas tree and an audio device to selectively produce Christmas sounds, a receiver controlled by a portable transmitter for selectively and simultaneously rotating the tree, energizing the illumination elements and actuating the audio device by transmitting signals from a remote location to the receiver for actuating single or multiple functions.

2. The stand as defined in claim 1, wherein said housing is of star shaped configuration including a plurality of circumferentially spaced star points at the lower edge of the housing.

3. The stand as defined in claim 2, wherein each of said star points is defined by alternating downwardly and outwardly inclined ridges and valleys forming the top wall on said housing.

4. The stand as defined in claim 2, wherein alternate star points extend a different distance from a center of said housing.

5. The stand as defined in claim 2, wherein said bottom wall includes a peripheral upwardly extending flange telescopically receiving a lower peripheral edge of said top wall.

6. The stand as defined in claim 1, wherein said housing top wall includes an opening in a central location, a clamp ring extending upwardly through said opening for receiving and clamping a Christmas tree trunk, said power device being drivingly connected to said clamp ring to rotate the Christmas tree.

7. The stand as defined in claim 1, wherein said top wall is detachably connected to said bottom wall to enable access to the interior of said housing.

8. The stand as defined in claim 1, wherein said power device includes a reversible motor to rotate the Christmas tree in selective rotational directions.

9. The stand as defined in claim 1, wherein said means to supply electrical energy to said illumination structures includes a power cord connected to said power device and a branch cord electrically connected to said power cord and extending upwardly from said housing and rotatable with the Christmas tree.

10. The stand as defined in claim 9, wherein said audio producing device includes a speaker mounted in an opening in said housing and connected to an audio producing structure in the housing powered from said power supply cord.

11. The stand as defined in claim 1, wherein said receiver includes an infrared signal receiver electrically connected to a control for said power device, said means supplying electrical energy to the Christmas tree and said audio producing device.

12. The stand as defined in claim 11 together with a battery powered infrared transmitter including separate switches for said power device, said means supplying electrical energy to the Christmas tree and said audio producing device.

13. The stand as defined in claim 1, wherein said Christmas sound is selected from any of music, songs, verbal message and a combination of any.

14. A stand which supports a decorative device for rotational movement in either direction which comprises a housing having a generally flat bottom wall for engaging a support surface and a generally conical top wall defining an open interior, said housing interior including a power device to selectively rotate said decorative device in either direction, electrical connectors to selectively supply electrical energy to lighting in said decorative device, an audio device to selectively produce sound, and electrical connectors to a receiver positioned outside said housing, said receiver controlled by a portable transmitter for selectively and simultaneously energizing said power device to rotate said decorative device, illuminate said lighting elements and actuate said audio device by transmitting signals from a remote location to said receiver.

15. The stand as defined in claim 14, wherein said decorative device is a Christmas tree.

16. The stand as defined in claim 14, wherein said generally conically shaped top wall is of star shaped configuration including a plurality of circumferentially spaced star points at the lower edge of said top wall.

* * * * *